United States Patent [19]

Frank

[11] 4,024,836

[45] May 24, 1977

[54] TRAVERSING LEHR SPRAY

[75] Inventor: Charles A. Frank, Bridgeton, N.J.

[73] Assignee: Owens-Illinois, Inc., Toledo, Ohio

[22] Filed: Mar. 22, 1976

[21] Appl. No.: 669,010

[52] U.S. Cl. ..... 118/323; 432/198

[51] Int. Cl.[2] ..... B05B 3/00

[58] Field of Search ..... 118/2, 323, 7, 305, 118/317, 321, 631; 427/269, 424; 134/172; 432/120, 121, 198

[56] References Cited

UNITED STATES PATENTS

| | | | |
|---|---|---|---|
| 2,925,801 | 2/1960 | Bivens et al. | 118/323 X |
| 2,926,101 | 2/1960 | Schaefer | 118/323 X |
| 3,195,501 | 7/1965 | Barkhau | 118/2 X |
| 3,479,208 | 11/1969 | Dubble et al. | 118/323 X |
| 3,509,852 | 5/1970 | Wells | 118/323 |
| 3,516,849 | 6/1970 | Shank et al. | 118/2 X |
| 3,924,565 | 12/1975 | Benner et al. | 118/323 |

*Primary Examiner*—Louis K. Rimrodt
*Attorney, Agent, or Firm*—D. T. Innis; E. J. Holler

[57] ABSTRACT

An apparatus for spraying between the rows of a plurality of rows of glass containers moving on a lehr mat. The spray traversing mechanism is of a commercial type which is mounted to extend through an opening in the roof of the lehr. The spraying device traverses transversely of the lehr mat. One end of the mechanism for supporting the spray traversing mechanism is pivotally mounted to a first wheeled member which is capable of being longitudinally and adjustably positioned at one side of the lehr. The other end of the traversing device is pivotally mounted to a second wheeled member, with the second wheeled member being reciprocated parallel to the direction of the movement of the lehr mat. The second wheeled member is moved at a rate such that the spray head will spray between the rows of bottles as they are moved on the lehr mat. The apparatus is designed such that conventional non-row-following lehr spray mechanisms may be converted to a row-following mechanism by following the teachings of the present invention.

7 Claims, 2 Drawing Figures

TRAVERSING LEHR SPRAY

BACKGROUND OF THE INVENTION

This invention relates to lehr spraying apparatus which sprays between the rows of glass containers moving on a lehr mat. It has been the practice to provide systems which move across the width of a lehr mat to spray containers with lubricating material. When the operating speeds of the lehrs are slow, it is relatively easy to move a spray mechanism across the lehr and return it during the interval of passage of a row past the line of movement of the spray mechanism. However, in the present day, most lehr mats are moving at a relatively high speed. The distance across the lehr is relatively large and in order to spray between the rows of containers, it has been found desirable to pivot or in some way track the movement of the bottles by the lehr spray head. The prior art suggests several techniques for tracking rows of moving containers, for example, U.S. Pat. Nos. 3,509,852; 3,516,849; 3,262,419 and 1,835,402. A fairly recent U.S. Pat. No. 3,924,565 suggests having the bulk of the traversing spray mechanism move back and forth across the width of the lehr and have a shiftable nozzle guided by a shiftable member that extends across the width of the lehr. This member is swiveled at one end and reciprocably mounted at its other end. This conventional system, with the added feature of the complicated nozzle mounting, requires a relatively large amount of room and would be incapable of mounting above the lehr, as the present invention. Applicant's invention permits the use of the prior art devices which were not capable of following a row to be inexpensively converted to a row-following device.

SUMMARY OF THE INVENTION

Apparatus for spraying between the rows of objects in columns with the rows being moved by a conveyor or lehr mat and wherein a spray unit is positioned across the width of a lehr wherein the improvement comprises a pair of horizontal rails at either side of the top of the lehr, with the rails extending parallel to the movement of the conveyor. A pair of wheeled members are mounted for longitudinal movement on the rails and a laterally extending support member which supports the spray unit is pivotally connected to both wheeled members, with means for positioning one of the wheeled members at an adjusted position and means for reciprocating the other wheeled members to thereby provide a system for spraying between the rows of the moving objects.

DETAILED DESCRIPTION OF THE DRAWINGS

Figure 1:
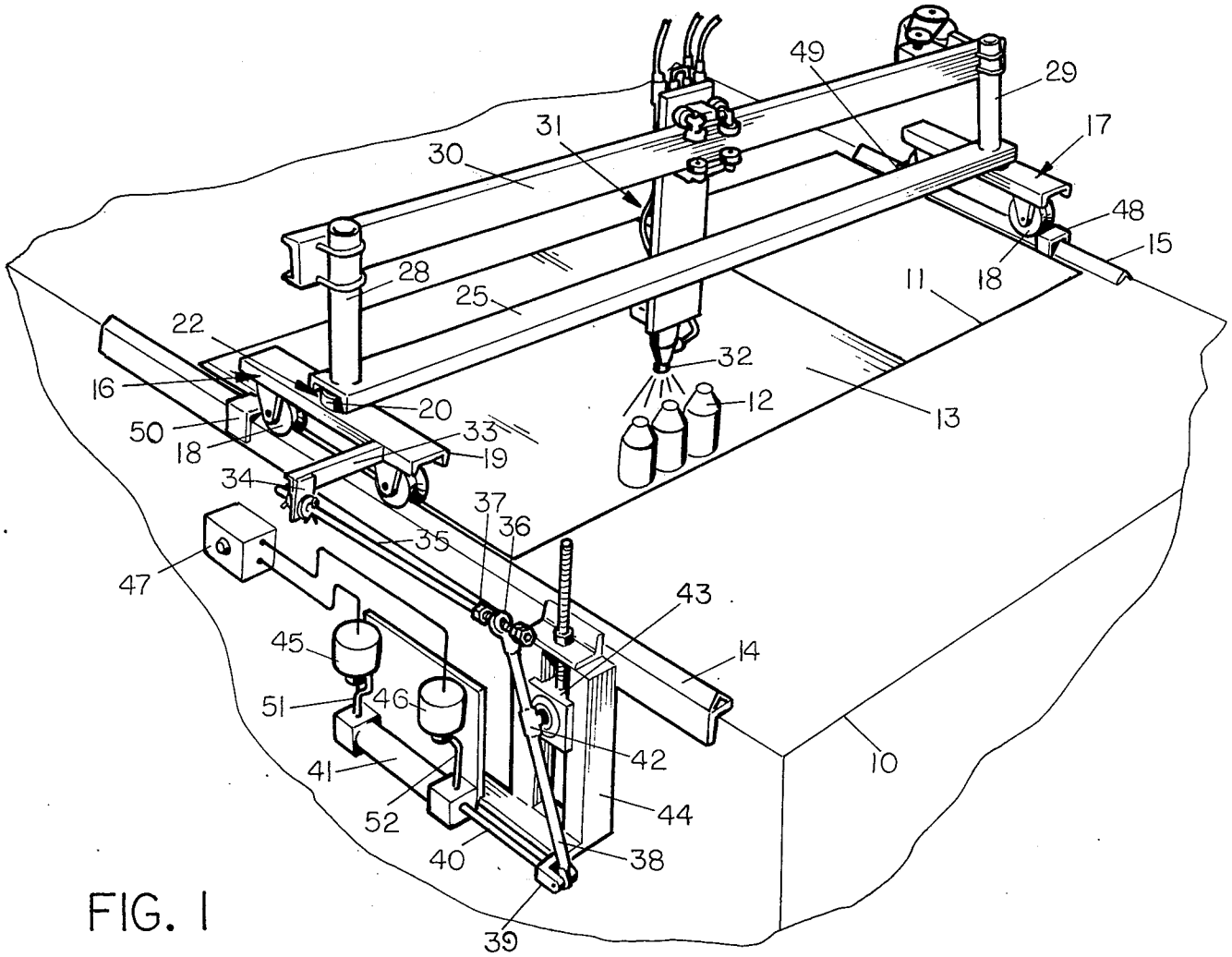
FIG. 1 is a perspective view of the apparatus of the invention.

With reference to the drawings and in particular FIG. 1, the details of the apparatus of the invention will be described.

A lehr, of the type disclosed in U.S. Pat. No. 2,926,101, is schematically shown as having an enclosure 10 and an opening 11 formed in the roof thereof, carries containers 12 on a moving lehr mat 13. It should be understood that the containers are moving on the lehr mat in the direction to the right. Only three containers are shown; however, in actual practice, the containers will be in rows which will extend across the width of the lehr, separated from each other by a space so that, in effect, the containers are in rows and columns. Such an arrangement of bottles in a lehr is illustrated schematically in U.S. Pat. No. 2,926,101. A first rail 14 is mounted to the top of the lehr and extends parallel to the length of the lehr. A second rail 15 is mounted to the top edge of the lehr and extends parallel to the length of the lehr, being positioned in opposing relationship to the first rail 14. A first wheeled member 16 is mounted on the first rail 14 and a second wheeled member 17 is mounted on the second rail 15. The rails 14 and 15 take the form of an inverted V and the wheeled members 16 and 17 each have a pair of wheels 18 whose configuration is such that they will embrace the inverted V rails 14 or 15.

Figure 2:
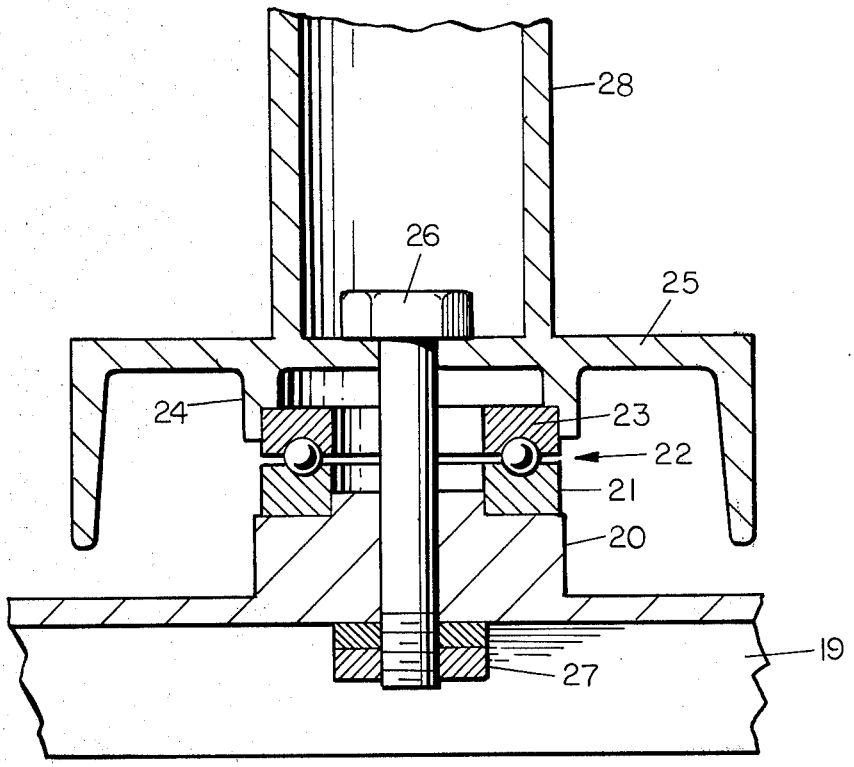
FIG. 2 is an enlarged, sectional view of the swivel or pivot mechanism of the invention.

With additional reference to FIG. 2, the wheeled member 16 takes the form of a channel iron 19, in the center of which is positioned a plate 20. The plate 20 serves as a mount for a lower race 21 of a thrust bearing 22. The thrust bearing 22 has an upper race 23 which is seated within an annular mounting member 24, with the mounting member 24 being fixed to the underside of a channel member 25. The channel member 25 serves as a support member which extends laterally across the full width of the lehr and has its opposite end provided with a thrust bearing similar to thrust bearing 22. A bolt 26 with nuts 27 threaded thereon extends through openings formed in the member 25 and channel iron 19 and serves to hold the thrust bearings in place and retain the wheeled members in pivotal relationship with respect to the channel member 25. A vertical post 28 extends upwardly from the upper surface of the channel member 25 in substantially axial alignment with the bolt 26. A similar post 29 extends upwardly from the opposite end of the channel member 25. These posts 28 and 29 support a beam 30 which, for all practical purposes, is identical to the beam disclosed in U.S. Pat. Nos. 3,195,501 or 2,926,101.

The beam 30 forms a part of a commercially available unit of the DeVilbiss Corporation of Toledo, Ohio, under the designation Model YDB.

As can readliy be seen, the beam supports a spray mechanism generally designated 31 having a spray head 32 at the lower end thereof, it being understood that the spray head 32 will be positioned at or slightly below the top of the containers 12 so that the containers will not receive the sprayed lubricating material within the interior thereof.

The wheeled member 16 has an outwardly extending bar 33 to the end of which is welded a plate 34. The plate 34 in turn has a rod 35 retained in a hole formed in the end of the plate. The rod 35 extends generally parallel to the rail 14 and at its end opposite the plate 34 carried a flexible connector 36. The connector 36 may have its position adjusted relative to the length of the rod 35 by changing the position of nuts 37 that are threaded thereon. The connector 36 is carried on the upper end of a rod 38 with the lower end of the rod 38 being connected by a clevis 39 to a piston rod 40 of an air motor 41. The rod 38, intermediate its length, passes through and is slideable in a collar 42 which is pivotally mounted to a block 43. The block 43 is vertically adjustable in a guide 44 with the vertical position of the block 43 determining the relative length of the arms of the rod 38 on opposite sides of the collar 42. In effect, the collar 42 serves as a fulcrum for the rod 38 and the length of the stroke of the motor 41 may be adjusted in regard to the length of movement of the rod 35. The movement of the rod may be selected as desired.

The motor 41 is controlled with respect to the frequency of its reciprocating movement by a pair of solenoid valves 45 and 46. The valves are connected to an air supply (not shown) and in turn are connected to opposite ends of the motor 41 by lines 51 and 52. A control box 47 supplies signals to the solenoids in predetermined timed sequence to effect the shifting or pivoting of the entire spray mechanism so that it will follow the rows of the containers on a diagonal. The wheeled member 17 is adjustable relative to its rail, but is fixed once its adjustment has been made by the positioning of stops 48 and 49 on the rail 15. In a like manner, a stop 50 is provided on the rail 14 and may be positioned such that it will prevent over-travel of the wheeled member 16 in one direction and in the opposite direction the wheeled member 16 is stopped by the extent of movement of the air motor in its retracting mode.

The above described apparatus operates in the manner that the motor 41 will position the member 16 at one extreme of its travel with the beam 30 extending across the width of the lehr but on a slight diagonal. After the spray head has made a traverse in one direction, the motor 41 will reverse and again position the beam on a slight but opposite diagonal. After being shifted, the spray head will traverse again. In this manner the row-following by the spray head is accomplished and the containers will be sprayed with a lubricant material on all sides.

I claim;

1. In apparatus for spraying between the rows of objects arrayed in rows and columns within a lehr and that are continuously being moved by a conveyor wherein a traversing spray unit is mounted to extend into the interior of and extend transversely across the lehr, said unit including a movable carriage that is reciprocated across said lehr, the improvement comprising:

a pair of horizontal rails at either side of the top of said lehr, said rails extending parallel to the movement of the conveyor;

a first wheeled member mounted for longitudinal movement on one of said rails;

a second wheeled member mounted for longitudinal movement on the other of said rails;

a laterally extending support member pivotally connected to both said wheeled members at opposite ends thereof;

a mounting post extending upward from each of said support member, said traversing spray unit mounted to and extending between said mounting posts;

means for positioning one of said wheeled members relative to its rail; and means for reciprocating the other of said wheeled members, said means for reciprocating the other of said wheeled members includes means for adjusting the length of the stroke of said reciprocating means whereby the spray unit is adapted to follow rows of objects moving on said conveyor regardless of the spacing of the rows of objects relative to each other by being capable of being adjusted to the spacing of the rows.

2. The apparatus of claim 1, wherein said lateral support member is pivoted to said wheeled members by a thrust bearing interposed therebetween, said thrust bearing having a lower, race supporting ring, welded to said wheeled members, and bolt means holding said thrust bearing and lateral support member in assembled relationship.

3. The apparatus of claim 1, wherein said reciprocating drive means comprises a fluid motor, said motor having its piston rod connected to the other of said wheeled members.

4. The apparatus of claim 3, wherein the piston rod is connected to one end of an arm, means pivotally supporting said arm intermediate its length, and means connecting the other end of said arm to the other of said wheeled members.

5. The apparatus of claim 4, further including means for adjusting the pivot position of said arm, thereby changing the extent of movement of the other end of said arm in relation to the stroke of the motor.

6. The apparatus of claim 5, wherein said arm pivot adjusting means comprises a threaded rod connected to a pivot block that is slideable in a slotted casting.

7. The apparatus of claim 6, further including means connected to said rails for limiting the extent of movement of said wheeled members on said rails.

* * * * *